United States Patent [19]

Schneider

[11] 4,227,316

[45] Oct. 14, 1980

[54] DISCHARGE DUCT FOR APPARATUSES FOR EXTRACTING WATER FROM CARPETS

[75] Inventor: Helmut Schneider, Mainz, Fed. Rep. of Germany

[73] Assignee: Werner & Mertz GmbH, Mainz, Fed. Rep. of Germany

[21] Appl. No.: 10,718

[22] Filed: Feb. 8, 1979

[30] Foreign Application Priority Data

Feb. 16, 1978 [DE] Fed. Rep. of Germany ..... 2806681

[51] Int. Cl.[3] ..... F26B 9/00

[52] U.S. Cl. ..... 34/151; 34/155; 34/160; 15/322; 15/405; 406/181; 406/195

[58] Field of Search ..... 15/321, 322, 405; 406/191, 195, 181; 34/155, 156, 160, 151

[56] References Cited

U.S. PATENT DOCUMENTS

| | | | |
|---|---|---|---|
| 3,495,932 | 2/1970 | Tuma | 34/160 |
| 4,018,483 | 4/1977 | Smith | 15/405 |
| 4,074,387 | 2/1978 | Arato et al. | 15/322 |

FOREIGN PATENT DOCUMENTS 2614661 10/1977 Fed. Rep. of Germany .

*Primary Examiner*—Larry I. Schwartz
*Attorney, Agent, or Firm*—Karl F. Ross

[57] ABSTRACT

A liquid-pickup apparatus for carpetry, e.g. for the removal of liquid from the shampooing of a carpet, comprises a slot-shaped compressed air outlet adjacent a discharge duct with an entry slot. The flattened cross-section duct rises at an angle to the horizontal and is subdivided internally into a plurality of channels of substantially the same cross section as the slot and having rounded bases.

11 Claims, 2 Drawing Figures

DISCHARGE DUCT FOR APPARATUSES FOR EXTRACTING WATER FROM CARPETS

FIELD OF THE INVENTION

The invention relates to an apparatus for extracting a liquid e.g. shampoo, from a wetted carpet, and, more particularly, to a device which is generally suitable for incorporation in a carpet shampooing machine which wets the carpet prior to shampoo removal and partial drying thereof.

BACKGROUND OF THE INVENTION

Earlier apparatus for extracting water from carpets are based on the principle that a liquid introduced into the carpet for removing dirt from the carpet, e.g. a shampoo, is removed by blowing air through the carpet pile, in a manner corresponding to dust discharge in conventional dust exhausters(e.g. vacuum cleaners). For blowing through the wet carpet such equipment may also use, instead of means for evacuating the liquid-/air mixture by suction, compressed air to displace the liquid/air mixture from the carpet (cf, for example, the equipment for extracting water from carpets illustrated in West German Offenlegungsschrift No. 24 14 661).

By contrast with conditions for the removal of dust-/air mixtures, in the case of liquid/air mixtures the shape of the discharge duct results in a smooth pattern of discharge as a result of the mutual cohesion force of the water droplets and gravitational force. Generally speaking, no attention has hitherto been devoted to this aspect in the construction and design of discharge ducts. In many cases the liquid/air mixture is collected - after it has left the carpet via a necessarily slot-like elongate outlet—in an obliquely upwardly-directed duct. However, the deflection of the air/water mixture led away from the initially horizontal lateral guide into a central discharge duct of relatively great cross-section creates unnecessary resistance forces. These resistance forces are further increased due to the fact that, in the discharge duct, the water is not removed in a uniform mixture with air but continues to flow back until the effective duct cross-section has so narrowed that large quantities of liquid are entrained, with some degree of force, i.e. the liquid "gulps". Very unfavorable flow conditions also occur when elongate narrow slot-like discharge ducts are used which, generally speaking, are extended vertically upwardly in an arcuate path of travel. The air flow follows the path of the least resistance, so that the greatest air speed is present in a flattened zone in the center of the cross-section viewed as a whole. The liquid in the air current is thrust towards both sides of the parallel slot and there meets the smallest air flow in the slot. The result is that the liquid flows laterally, particularly in the case of flat discharge ducts, and continues to accumulate at the lower duct end until the whole duct cross-section has become filled with liquid. The accumulated store of liquid, which fills out the duct, is periodically expelled in its entirety. This process is continuously repeated and has the result that not only is a gas flow pressure required which is sufficient to overcome the flow resistance in the carpet and at the walls of the discharge duct, but also that the pressure must be sufficient to raise the water the necessary height and also to overcome the resistance derived from the above-described backflow of the water.

For solving this problem a duct was developed for the apparatus described in Offenlegungsschrift No. 26 14 661. Here, the discharge duct is such that the liquid-/air mixture is initially collected in a transverse duct and is laterally upwardly guided, by way of an arcuate hose having a large radius of curvature, to a circular collecting container. In this construction of the discharge duct the harmful backflow of liquid was in large measure eliminated, and a uniform discharge flow achieved by preventing any accumulation of the liquid in the duct. However, these advantages were achieved at the expense of a relatively long duct flow path, with deflections in the direction of flow, and through the provision of elaborate means for collecting the liquid.

OBJECT OF THE INVENTION

The object of this invention is the provision of a discharge duct which is capable of bringing the liquid-/air mixture displaced from the carpet to a level suitable for overflowing into a collecting vessel without any substantial backflow of liquid and subject to the least possible resistance.

SUMMARY OF THE INVENTION

The invention provides an apparatus for extracting liquid from a wetted carpet by blowing gas through the carpet, which comprises:

a gas duct for blowing gas through the carpet and which has a gas exit slot at a lower end thereof;

a discharge duct for discharge of a gas/liquid mixture from the carpet and having at a lower end an entry slot adjacent the gas exit slot and an upper end communicating with a liquid container;

the discharge duct having an overall cross-section substantially the same as the cross-section of the entry slot, and being divided into a plurality of separate upwardly extending channels;

each channel having a base which is curved in cross-section;

and the channels being inclined at an angle not greater than 60° to the horizontal.

The invention is particularly characterized by:

(1) the narrowness, considered as a whole, of the slot; although the width of the entry slot for the liquid/air mixture from the carpet is maintained;

(2) the subdivision of the discharge duct into a plurality of individual channels, which are arranged side by side and run upwards; each channels having a rounded base and a flat or possibly arched top, and (3) the arrangement whereby the duct extends over its entire length at an angle inclined obliquely upwardly with respect to the horizontal e.g. along the direction of working movement; angles of inclination steeper than 60° are avoided and, in particular, vertical sections are not present.

Due to the narrow entry slot shape at the place at which the liquid/gas mixture leaves the carpet, it has been found to be possible to avoid the use of a long horizontal lateral guide for the liquid/gas e.g. air/water, mixture to be led to a central discharge duct. Thus, in each blower- or suction-nozzle the essential work takes place in a narrowly-restricted area in front of the entry slot of the discharge duct, and this narrowly-restricted area is naturally narrow elongate. If the narrow slot-like duct were defined by two parallel plane opposed surfaces, which were closed at the sides of arcuate surfaces, the liquid in the gas current would be displaced towards both sides, i.e. to the arcuate surfaces, and would be there subjected to the smallest air flow in the slot. Thus, the possibility of backflow of the liquid could not be excluded. On the other hand, the subdivision of the duct into individual upwardly closed channels prevents the liquid from being forced out of the main air flow path.

However, with this construction uniform conveyance of liquid by the gas i.e. substantially without backflow, can only be realized if the third feature, i.e. the oblique orientation of the discharge duct as a whole, is implemented. Thus, due to the angle of inclination of the duct, gravitational force so acts on the liquid to be conveyed that this liquid tends to flow to the deepest point of each channel profile, i.e. to the base of the channel, where this liquid is subject to an undiminished air flow speed. An angle of inclination of substantially 45° has been found to be most preferred. Steeper angles tend to lead to an increased backflow of the liquid in the opposite direction to the upflowing gas, so that an excessive pressure is created at the entry slot of the discharge duct on the carpet. The result is that liquid tends to be thrust through the carpet to untreated carpet. Smaller angles tend to lead to unnecessarily increased structural length and discharge duct length, in order to bring the displaced liquid to the height of the collecting vessel.

The preferred profile for the curved base portion of the duct channels has been found to be a shallow semi-ellipse, the ratio of whose greater (major) diameter to the smaller (minor) diameter is 3:1 or 3: (less than 1). Thus, there are provided a number of flattened or shallow channels in which the upper confines are constituted by a plane surface or by a somewhat arched surface, and the lower confines are constituted by a half-ellipse. Across the profile of such a slot-like channel, the highest air speed is in each case a short distance above highest air speed is in each case a short distance above the lowest point, that is to say at the precise point at which the liquid is repeatedly accumulated by the effect of centrifugal force and entrained.

The upper end of the semi-elliptical channels may have a progressive increase in cross-section and at an upper end can be turned obliquely downwardly into the collecting vessel.

The individual channels may be milled in a common plate, to which is juxtaposed a suitable cover plate. However, these grooves may also be formed as individual ducts which are placed together in side-by-side relation.

In an embodiment of the discharge duct suitable to be incorporated in an apparatus of the type referred to above in Offenlegungsschrift No. 26 14 661, the slot length of the duct was about 25 cm, and seven semi-elliptical channels of 3 cm width each and 1 cm depth were placed side by side. The angle of inclination was about 45°. As the air which conveys the liquid no longer arrives in the form of a jet or stream from a tube at the receiving container, as before, it was no longer necessary to provide a rounded receiving container, so that the latter could be made rectangular, so as to accord with the overall shape of the apparatus. The path length of the discharge air, which entrains the liquid, from the carpet to the receiving container is reduced to about one-fifth of that present in the case of earlier equipments equipped with arcuate hoses. In spite of the shallow or flattened shape of the outlet cross-section (as a whole) of the discharge duct, there is such a considerable reduction of the outlet resistance that the equipment according to the invention is appreciably more efficient in respect of water extraction. This improvement is allied to a simplification in design and simpler manufacture, and also leads to improved use of the space available for the receiving container in relation to the size of the equipment. Simplified operation and servicing also results.

The same advantages which are attainable in the case of compressed air equipment are also attainable, in analogous fashion, in the case of an apparatus employing air suction using dust exhausters (e.g. vacuum cleaners). In contrast to the case where compressed air operated apparatus is used, in apparatus using air suction there is an increased dependence on efficient utilization of the pressure head of the available air stream.

BRIEF DESCRIPTION OF THE DRAWING

A preferred embodiment of the invention will now be described with reference to the attached drawing, wherein.

SPECIFIC DESCRIPTION

Figure 1:
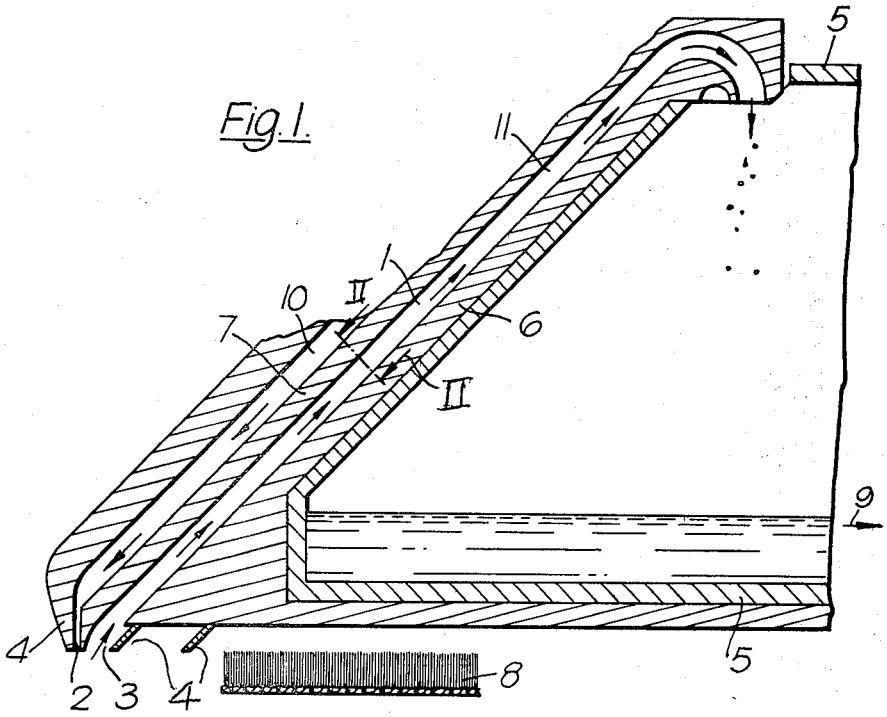
FIG. 1 is a partial longitudinal section of an apparatus according to the invention and including the section along line I—I of FIG. 2.

FIG. 1 shows a partial schematic view of an apparatus for removing liquid from a wetted carpet. The apparatus is part of a mobile shampooing device which applies shampoo to the carpet (by a means not shown) prior to removing the shampoo liquid by the illustrated apparatus. The position of a wet carpet 8 prior to extraction is schematically illustrated, and the direction of movement of the shampooing device is shown by the arrow 9.

FIG. 1 is a partial longitudinal cross section through the water-extraction apparatus at a point where one of the channels 1 is met at its deepest base part. As indicated by the arrows, the compressed air flows through air duct 10 and out of compressed air feed slot 2, through the carpet and into the liquid/air entry slot 3. This compressed air is prevented from flowing into the rest of the carpet by lateral sealing means (not shown) and also by front and rear sealing means 4. The compressed air drives the liquid out of the carpet into the collecting container 5 through the channels 1.

The angle of inclination of the straight discharge duct 11 to the horizontal direction of forward movement indicated by arrow 9 is substantially 45°.

Figure 2:
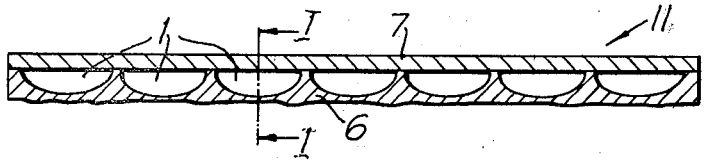
FIG. 2 is a section alone line II—II of FIG. 1.

FIG. 2 is a cross-section through the discharge duct 11 and channels 1. The channels are hollowed out of a base part 6 and are upwardly sealed by a flat cover 7. As may be appreciated the cross-sectional base profile of each channel 1 is substantially semi-elliptical.

The apparatus operates as follows, after positioning on a wet shampooed carpet 8. Compressed air is forced down the air duct 10 by compressor means (not shown) and exits through slot 2. The air is retained in the slot region by the lateral seals and front and rear seals 4; passes through carpet pile in this slot region and entrains the liquid shampoo therefrom. The mixture of air and shampoo is forced up the discharge duct 11, possibly with the assistance of suction applied to the duct 11, and passes through the semi-elliptical channels 1, wherefrom the liquid falls into the open top of container 5 and the air passes out of the container.

I claim:

1. An apparatus for extracting liquid from a wetted carpet by blowing gas through the carpet, which comprises a gas duct for blowing gas through the carpet and which has a gas exit slot at the lower end thereof;

a discharge duct for discharge of a gas/liquid mixture from the carpet and having at a lower end an entry slot adjacent said gas exit slot and an upper end communicating with a liquid container, the discharge duct having an overall cross-section substantially the same as the cross-section of the entry slot;

means subdividing said discharge duct into a plurality of separate upwardly extending channels, each of said channels having a base which is curved in cross-section, the channels being inclined at an angle not greater than 60° with respect to the horizontal.

2. An apparatus according to claim 1, wherein an upper portion of each channel is formed with a passage which is arched in longitudinal cross-section and communicates with said container.

3. An apparatus according to claim 1 or 2, which further comprises means for moving the apparatus in a direction relative to the carpet.

4. An apparatus according to claim 3, wherein the gas exit slot extends transversely of the direction of movement and is downwardly directed towards the carpet; and the entry slot extends parallel to the gas exit slot and opens upwardly into the discharge duct.

5. An apparatus according to claim 1, which comprises sealing means extending around the gas exit slot and the entry slot so as to prevent escape of gas and liquid to adjacent areas of the carpet not being acted upon.

6. An apparatus according to claim 1, wherein the liquid container is open at an upper end thereof to receive liquid from the discharge duct.

7. An apparatus according to claim 1, wherein the angle of inclination of the channels is substantially 45°.

8. An apparatus according to claim 1, wherein the base of each channel is of semi-elliptical shape.

9. An apparatus according to claim 8, wherein the ratio of short to long axis of the ellipse is substantially 1:3, the long axis being disposed horizontally.

10. An apparatus according to claim 1, wherein the width of each channel is substantially 3 cm.

11. An apparatus according to claim 1, wherein the width and depth of the channels increases in the upward direction.

* * * * *